US010927654B2

(12) United States Patent
El-Hayek et al.

(10) Patent No.: US 10,927,654 B2
(45) Date of Patent: Feb. 23, 2021

(54) RECOVERING HYDROCARBONS IN MULTI-LAYER RESERVOIRS WITH COILED TUBING

(71) Applicant: Saudi Arabian Oil Company, Dhahran (SA)

(72) Inventors: Soha Omar El-Hayek, Dhahran (SA); Essam M. Alyan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/421,185

(22) Filed: May 23, 2019

(65) Prior Publication Data

US 2020/0370401 A1 Nov. 26, 2020

(51) Int. Cl.

| | |
|---|---|
| ***E21B 43/14*** | (2006.01) |
| ***E21B 33/12*** | (2006.01) |
| ***E21B 33/13*** | (2006.01) |

(52) U.S. Cl.

CPC ..... *E21B 43/14* (2013.01); *E21B 33/12* (2013.01); *E21B 33/13* (2013.01)

(58) Field of Classification Search

CPC ..... E21B 43/14; E21B 41/0035; E21B 43/30

See application file for complete search history.

(56) References Cited

U.S. PATENT DOCUMENTS

| | | | |
|---|---|---|---|
| 2,738,013 | A | 3/1956 | Lynes |
| 2,986,214 | A | 5/1961 | Wiseman et al. |
| 3,333,635 | A | 8/1967 | Crawford |
| 3,527,298 | A | 9/1970 | Varty et al. |
| 4,498,543 | A | 2/1985 | Pye |
| 5,353,875 | A | 10/1994 | Schultz et al. |
| 5,411,082 | A | 5/1995 | Kennedy |

(Continued)

FOREIGN PATENT DOCUMENTS

| | | |
|---|---|---|
| EP | 0796980 | 9/1997 |
| WO | 01161146 | 8/2001 |

OTHER PUBLICATIONS

Geddes et al., "Innovative Water Shutoff Solutions Using Coiled Tubing Conveyed Inflatable Devices," SPE-76709, SPE Western Regional/AAPG Pacific Section Joint Meeting, Anchorage, Alaska, May 20-22, 2002, 10 pages.

(Continued)

*Primary Examiner* — Andrew Sue-Ako

(74) *Attorney, Agent, or Firm* — Fish & Richardson P.C.

(57) ABSTRACT

A first layer of the multi-layered reservoir is produced through a coiled tubing production string. The coiled tubing production string is located within a wellbore that includes a first horizontal section within the first layer. The coiled tubing production string includes a packer at a downhole end of the coiled tubing production string. The packer seals an annulus that is defined by an outer surface of the coiled tubing production string and an inner surface of the wellbore. The coiled tubing is retracted from the first layer of the multi-layered reservoir to a second layer of the multi-layered reservoir. The second layer is uphole of the first layer. The first layer is sealed from the second layer. The second layer produced through the coiled tubing production string. The coiled tubing production string is located within the wellbore that includes a second horizontal section within the second layer.

24 Claims, 5 Drawing Sheets

(56) References Cited

U.S. PATENT DOCUMENTS

| | | | | |
|---|---|---|---|---|
| 5,427,177 | A | 6/1995 | Jordan, Jr. et al. | |
| 5,449,039 | A | 9/1995 | Hartley et al. | |
| 5,662,165 | A | 9/1997 | Tubel et al. | |
| 5,664,628 | A | 9/1997 | Koehler et al. | |
| 5,671,809 | A | 9/1997 | McKinzie | |
| 5,697,441 | A | 12/1997 | Vercaemer | |
| 5,704,426 | A | 1/1998 | Rytkewsju et al. | |
| 5,730,221 | A | 3/1998 | Longbottom et al. | |
| 6,082,454 | A | 7/2000 | Tubel | |
| 6,318,469 | B1 | 11/2001 | Patel | |
| 6,394,184 | B2 | 5/2002 | Tolman et al. | |
| 6,446,727 | B1 | 9/2002 | Zemlak et al. | |
| 6,497,290 | B1 | 12/2002 | Misselbrook et al. | |
| 6,615,920 | B1 | 9/2003 | Collins et al. | |
| 6,745,834 | B2 | 6/2004 | Davis | |
| 8,220,547 | B2 | 7/2012 | Craig et al. | |
| 8,528,630 | B2 | 9/2013 | Tunget et al. | |
| 8,555,978 | B2 | 10/2013 | Ganelin et al. | |
| 9,016,391 | B1 | 4/2015 | Chauffe | |
| 9,140,119 | B2 | 9/2015 | Deen et al. | |
| 9,249,559 | B2 | 2/2016 | Dyer | |
| 9,328,600 | B2 | 5/2016 | Kaminsky et al. | |
| 9,416,638 | B2 | 8/2016 | Zhou | |
| 9,493,993 | B1 | 11/2016 | Dallas et al. | |
| 9,513,055 | B1 | 12/2016 | Seal | |
| 9,644,463 | B2 | 5/2017 | Dallas | |
| 9,863,414 | B2 | 1/2018 | Laing et al. | |
| 9,951,573 | B2 | 4/2018 | Dahl et al. | |
| 10,352,140 | B2 | 7/2019 | Parlin et al. | |
| 2006/0090903 | A1* | 5/2006 | Gano | E21B 33/12 166/384 |
| 2006/0207763 | A1 | 9/2006 | Hofman | |
| 2010/0319928 | A1 | 12/2010 | Bussear et al. | |
| 2011/0048743 | A1 | 3/2011 | Stafford et al. | |
| 2011/0192596 | A1 | 8/2011 | Patel | |
| 2012/0318582 | A1* | 12/2012 | Fould | E21B 41/0035 175/61 |
| 2013/0043025 | A1* | 2/2013 | Scott | E21B 43/305 166/276 |
| 2013/0081807 | A1* | 4/2013 | Dyer | E03B 3/14 166/254.2 |
| 2016/0333680 | A1 | 11/2016 | Richter et al. | |
| 2017/0321548 | A1 | 11/2017 | Enkababian et al. | |
| 2018/0119533 | A1* | 5/2018 | Alhuthali | E21B 43/305 |
| 2018/0155991 | A1 | 6/2018 | Arsalan et al. | |
| 2018/0363460 | A1 | 12/2018 | Fitzel et al. | |
| 2019/0032473 | A1 | 1/2019 | Kuckes | |

OTHER PUBLICATIONS

Head et al., "Slim Well Concept—Innovative Coiled Tubing Completion Technology," SPE-54492, 1999 SPE/ICoTA Coiled Tubing Roundtable, Houston, Texas, May 25-26, 1999, 14 pages.

Ramondenc et al., "Reviving Oil Production in a Mature Offshore Field through Downhole Coiled Tubing Completion," SPE-179063, SPE/ICoTA Coiled Tubing and Well Intervention Conference and Exhibition in Houston, Texas, Mar. 22-23, 2016, 11 pages.

PCT International Search Report and Written Opinion in International Appln. No. PCT/US2019/057558, dated Feb. 17, 2020, 14 pages.

Al-Ariami et al., "Striving the coil tubing limit intervention in a snake 'Long Horizontal' Complex Gas well: successful perforation and completion," SPE 105159, presented at the Coiled Tubing and Well Intervention Conference and Exhibition, the Woodlands, TX, Mar. 20-21, 2007, 8 pages.

Cooper et al., "Coiled tubing in horizontal wells," SPE 17581, presented at the SPE International Meeting on Petroleum Engineering, Tianjin, China, Nov. 1-4, 1988, 12 pages.

PCT International Search Report and Written Opinion in International Appln. No. PCT/US2020/034221, dated Aug. 11, 2020, 15 pages.

* cited by examiner

RECOVERING HYDROCARBONS IN MULTI-LAYER RESERVOIRS WITH COILED TUBING

TECHNICAL FIELD

This disclosure relates to hydrocarbon production.

BACKGROUND

In hydrocarbon production, wells are drilled to penetrate target reservoirs which usually include different geological layers. All the reservoir layers can be produced simultaneously during the life time of the well, resulting in more production from dominant layers while production from the less prolific layers. For vertical wells, casings can be run across the wellbore with sequential perforations starting from the deepest layers to ensure better sweep efficiency across all layers; however, this is not applicable in horizontal wells. Typically, the wells are connected to a topside facility where it the hydrocarbons can be processed for transportation and refinement. In some instances, the wells could be re-completed to target unswept reservoir zones or abandoned after a period of time when its drainage area is depleted.

SUMMARY

This disclosure describes technologies relating to depleting reservoirs with coiled tubing.

An example implementation of the subject matter described within this disclosure is a method of producing from a multi-layered reservoir. The method has the following features. A first layer of the multi-layered reservoir is produced through a coiled tubing production string. The coiled tubing production string is located within a wellbore that includes a first horizontal section within the first layer. The coiled tubing production string includes a packer at a downhole end of the coiled tubing production string. The packer seals an annulus that is defined by an outer surface of the coiled tubing production string and an inner surface of the wellbore. The annulus is sealed from the first layer. The coiled tubing is retracted from the first layer of the multi-layered reservoir to a second layer of the multi-layered reservoir. The second layer is uphole of the first layer. The first layer is sealed from the second layer. The second layer produced through the coiled tubing production string. The coiled tubing production string is located within the wellbore that includes a second horizontal section within the second layer.

Aspects of the example method, which can be combined with the example method alone or in combination, include the following. The packer is unsealed prior to retracting the coiled tubing from the first layer to the second layer. The packer is retracted with the coiled tubing. The packer is retrieved from the wellbore. A second packer is installed and resealed after retracting the coiled tubing from the first layer to the second layer. The second packer seals the annulus from the second layer.

Aspects of the example method, which can be combined with the example method alone or in combination, include the following. The coiled tubing is retracted from the second layer of the multi-layered reservoir to a third layer of the multi-layered reservoir. The third layer is uphole of the second layer. The second layer is sealed from the third layer. The third layer is produced from through the coiled tubing production string.

Aspects of the example method, which can be combined with the example method alone or in combination, include the following. Retracting the coiled tubing includes using a coiled tubing truck.

Aspects of the example method, which can be combined with the example method alone or in combination, include the following. Sealing the first layer from the second layer includes installing a plug.

Aspects of the example method, which can be combined with the example method alone or in combination, include the following. The plug includes a cement plug or an expandable plug.

Aspects of the example method, which can be combined with the example method alone or in combination, include the following. The first horizontal section includes an open-hole completion.

Aspects of the example method, which can be combined with the example method alone or in combination, include the following. The second horizontal section includes an open-hole completion after retracting the coiled tubing to the second layer.

An example implementation of the subject matter described within this disclosure is a well-system with the following features. A wellbore is formed in a layered reservoir. The wellbore includes a first horizontal section within a first layer of the reservoir and a second horizontal section within a second layer of the reservoir. The second horizontal section is uphole of the first horizontal section. A length of coiled tubing extends through the wellbore from a topside facility to the first horizontal section. An annular packer is positioned at a downhole end of the length of coiled tubing. The annular packer seals an annulus defined by an outer surface of the length of coiled tubing and an inner surface of the wellbore. The annular packer seals the annulus from the first horizontal section.

Aspects of the example system, which can be combined with the example system alone or in combination, include the following. The wellbore further includes a third horizontal section within a third layer of the reservoir. The third horizontal section is uphole from the second horizontal section.

Aspects of the example system, which can be combined with the example system alone or in combination, include the following. The first layer is stratigraphically lower than the second layer, and the second layer is stratigraphically lower than the third layer.

Aspects of the example system, which can be combined with the example system alone or in combination, include the following. The second horizontal section and the third horizontal section are connected by a vertical section or a deviated section.

Aspects of the example system, which can be combined with the example system alone or in combination, include the following. The annular packer is a retrievable annular packer.

Aspects of the example system, which can be combined with the example system alone or in combination, include the following. The first horizontal section and the second horizontal section are connected by a vertical section or a deviated section.

Aspects of the example system, which can be combined with the example system alone or in combination, include the following. The first horizontal section includes an open-hole completion.

An example implementation of the subject matter described within this disclosure is a method of completing a well within a multilayered reservoir. The method include the following features. A wellbore is formed. The wellbore includes a first horizontal section within a first layer of the reservoir and a second horizontal section within a second layer of the reservoir. The second horizontal section is uphole of the first horizontal section. A coiled tubing string is inserted such that a downhole end is within the first horizontal section. A packer is seated at a downhole end of the coiled tubing string. The packer seals an annulus defined by an outer surface of the coiled tubing string and an inner surface of the wellbore. The packer seals the annulus from the first horizontal section.

Aspects of the example method, which can be combined with the example method alone or in combination, include the following. Fluid is produced through the coiled tubing from the first horizontal section.

Aspects of the example method, which can be combined with the example method alone or in combination, include the following. The first horizontal section and the second horizontal section are connected by a vertical section or a deviated section.

Aspects of the example method, which can be combined with the example method alone or in combination, include the following. The first horizontal section is completed with an open-hole completion.

Aspects of the example method, which can be combined with the example method alone or in combination, include the following. Forming the wellbore further includes forming a third horizontal section within a third layer of the reservoir. The third horizontal section is uphole from the second horizontal section.

Aspects of the example method, which can be combined with the example method alone or in combination, include the following. The second horizontal section and the third horizontal section are connected by a vertical section or a deviated section.

Aspects of the example method, which can be combined with the example method alone or in combination, include the following. The first layer is stratigraphically lower than the second layer, and the second layer is stratigraphically lower than the third layer.

Aspects of the example method, which can be combined with the example method alone or in combination, include the following. Forming the wellbore includes using a drilling rig.

Aspects of the example method, which can be combined with the example method alone or in combination, include the following. Completing the wellbore in the second layer does not require using a drilling rig.

Particular implementations of the subject matter described in this disclosure can be implemented so as to realize one or more of the following advantages. The recovery factor for hydrocarbon production is increased as individual layers are fully produced before moving on to subsequent layers avoiding dominant effect of a prolific layer. As open-hole completions can be used, oil production can be accelerated. Deployment of coiled tubing will take care of dog-leg severity due to their flexibility, and take care of the well-bore size adaptation due to their wide range of sizes. As well, the coil-tubing can be re-used elsewhere when the reservoir is depleted. No drill rig is needed for subsequent stages of re-completion.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

During hydrocarbon production, there are often hydrocarbons left in place, as they cannot be economically or technically produced. A goal of developing a production plan for a given hydrocarbon reservoir involves determining how to extract as much hydrocarbon out of the reservoir. Often times this is referred to as the "recovery factor" of the reservoir. The goal is generally to have the recovery factor be as high as is feasible.

This disclosure relates to a method of producing a multilayered reservoir with coiled tubing. One horizontal well is drilled step wisely (stair-way) through many overlying production layers. The horizontal is a continuity of horizontal sections drilled at the top of each producing layer simultaneously crossing vertically or slanted from one layer to the next one forming a step design single wellbore. The well might be drilled with a coiled tubing drilling stringer or with regular drilling pipe. The length of coiled tubing is extended through the wellbore to the bottom layer, where the annulus between the coiled tubing and the wall of the wellbore is sealed with a packer. The lower level is produced until the water-cut is too substantial, then the coiled tubing is retracted to the next layer. The packer is then re-seated, and the lower layer is abandoned. The process is repeated for each subsequent layer. Such a process allows a greater total hydrocarbon recovery from the reservoir by reducing the effect of more prolific production layers.

Figure 1:
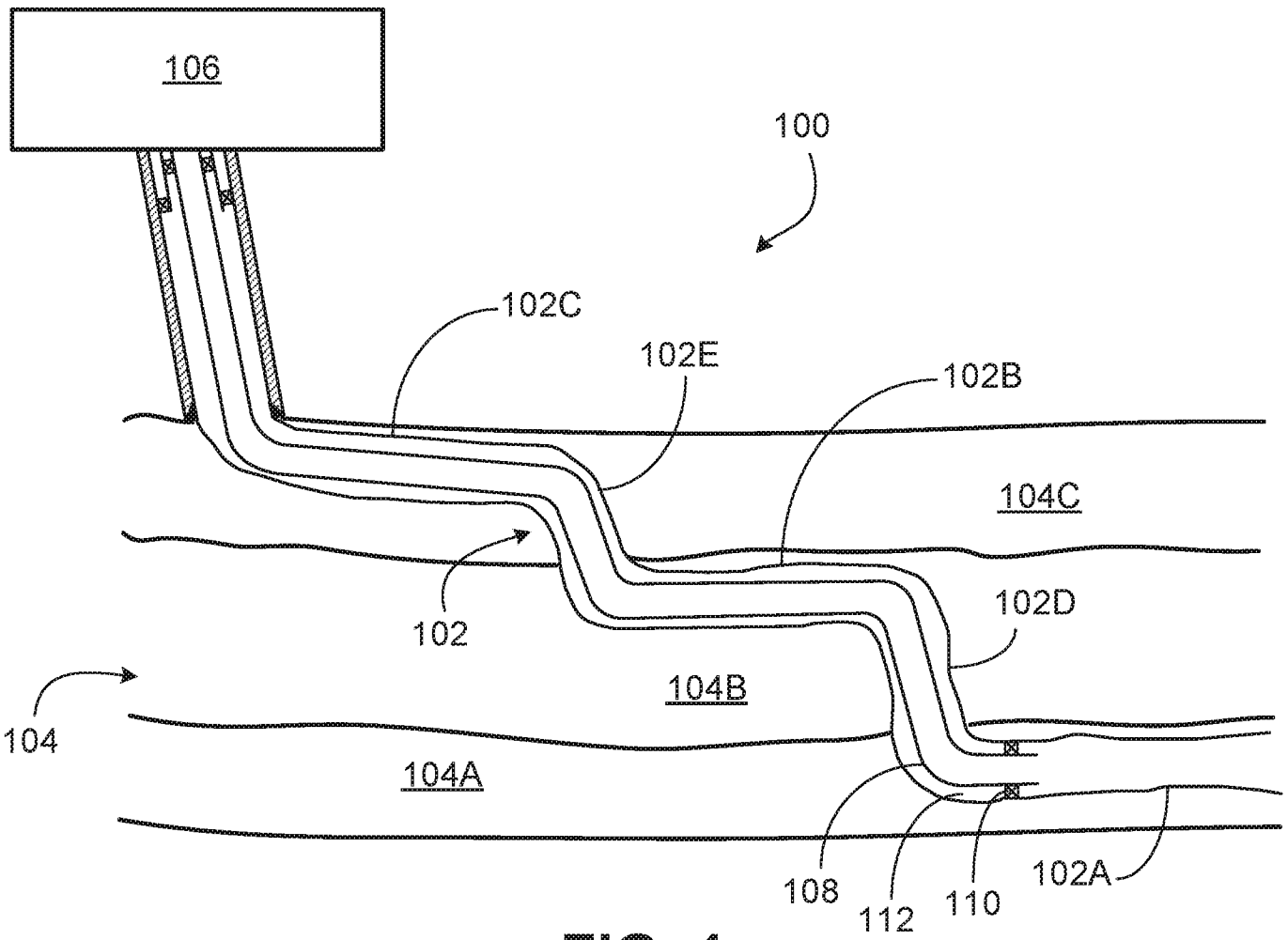
FIG. 1 is a schematic diagram of an example well production system at a first stage of production of a multi-layered reservoir with adjacent production layers.

FIG. 1 is a schematic diagram of an example well production system 100 at a first stage of production. The well production system 100 includes a wellbore 102 formed in a layered reservoir 104. The layered reservoir 104 in this example includes 3 horizontal production layers: a first horizontal layer 104*a*, a second horizontal layer 104*b*, and a third horizontal layer 104*c*. The first horizontal layer 104*a* is stratigraphically lower than the second horizontal layer 104*b*. The second layer 104*b* is stratigraphically lower than the third layer 104*c*.

The wellbore 102 passes through the first layer 104*a*, the second layer 104*b*, and the third layer 104*c*. As illustrated, the wellbore 102 includes a first horizontal section 102*a* within a first layer 104*a* of the reservoir 104. A second horizontal section 102*b* is located within a second layer

104*b* of the reservoir 104. The second horizontal section 102*b* is uphole of the first horizontal section 102*a*. The second horizontal section 102*b* is connected to the first horizontal section 102*a* by a first deviated or vertical section 102*d*. The first deviated or vertical section 102*d* connects a downhole end of the second horizontal section 102*b* to an uphole end of the first horizontal section 102*a*. As illustrated, the wellbore 102 includes a third horizontal section 102*c* within a third layer 104*c* of the reservoir 104. The third horizontal section 102*c* is uphole of the second horizontal section 102*b*. The third horizontal section 102*c* is connected to the second horizontal section 102*b* by a second deviated or vertical section 102*e*. The second deviated or horizontal section 102*e* connects a downhole end of the third horizontal section 102*c* to an uphole end of the second horizontal section 102*b*. In general, the wellbore 102 forms a step pattern through the various layers of the layered reservoir 104, and the wellbore 102 includes a horizontal section within each layer.

While generally described as a step pattern, a serpentine pattern can be used to similar effect without departing from this disclosure. In some implementations, a serpentine pattern can be combined with a step pattern depending on the topology of the individual reservoir. While the reservoir 104 and wellbore 102 are described within this disclosure as having three layers with three horizontal sections, greater or fewer layers and subsequent horizontal sections can be used without departing from this disclosure.

At an uphole end of the wellbore 102, a topside facility 106 is positioned to receive production fluid from the wellbore. The topside facility can include separators, pumps, compressors, amine units, glycol units, storage tanks, or any other equipment to assist in hydrocarbon production, hydrocarbon processing, or both. Extending into the wellbore 102 from the topside facility is a length of coiled tubing 108. The length of coiled tubing 108 extends though the wellbore 102 into the first horizontal section 102*a*. The length of coiled tubing 108 fluidically connects the first horizontal section 102*a* to the topside facility for production. While primarily described as using a length of coiled tubing, any downhole-type tubular (production string, liner, casing, etc.) can be used without departing from this disclosure. An annular packer 110 is positioned at a downhole end of the length of coiled tubing 108. The annular packer seals an annulus 112 defined by an outer surface of the length of coiled tubing 108 and an inner surface of the wellbore 102. The annular packer 110 seals the annulus 112 from the first horizontal layer 104*a*. "Seal" in the context of this disclosure refers to completely blocking fluid flow or partly blocking fluid flow. In some implementations, the annular packer 110 is a retrievable annular packer. The illustrated implementation shows an open-hole completion within the first horizontal section 102*a*. Other well completions can be used depending on wellbore stability, production zone length, production rate, well economics, any combination of these reasons, or any other reason.

Once the well is completed, the first layer 104*a* of the multi-layered reservoir 104 is produced through the coiled tubing length 108. That is, the coiled tubing length 108 acts as a production string. In the context of this disclosure, the terms "coiled tubing length" and "production string" may be used interchangeably. Producing from the first horizontal section 102*a* refers to directing production fluid from the first horizontal layer 104*a*, through the first horizontal section 102*a*, and up the length of coiled tubing 108 to the topside facility 106. Production fluid can include liquid hydrocarbons, water, gaseous hydrocarbons, or any combination and ratio of these. Production from the first horizontal section 102*a* continues until the ratio of hydrocarbons to other production fluids, such as water, decreases to be less than a specified threshold. Once the water cut becomes too great (hydrocarbon ratio becomes too small), an operator may move on to a second stage of production.

Figure 2:
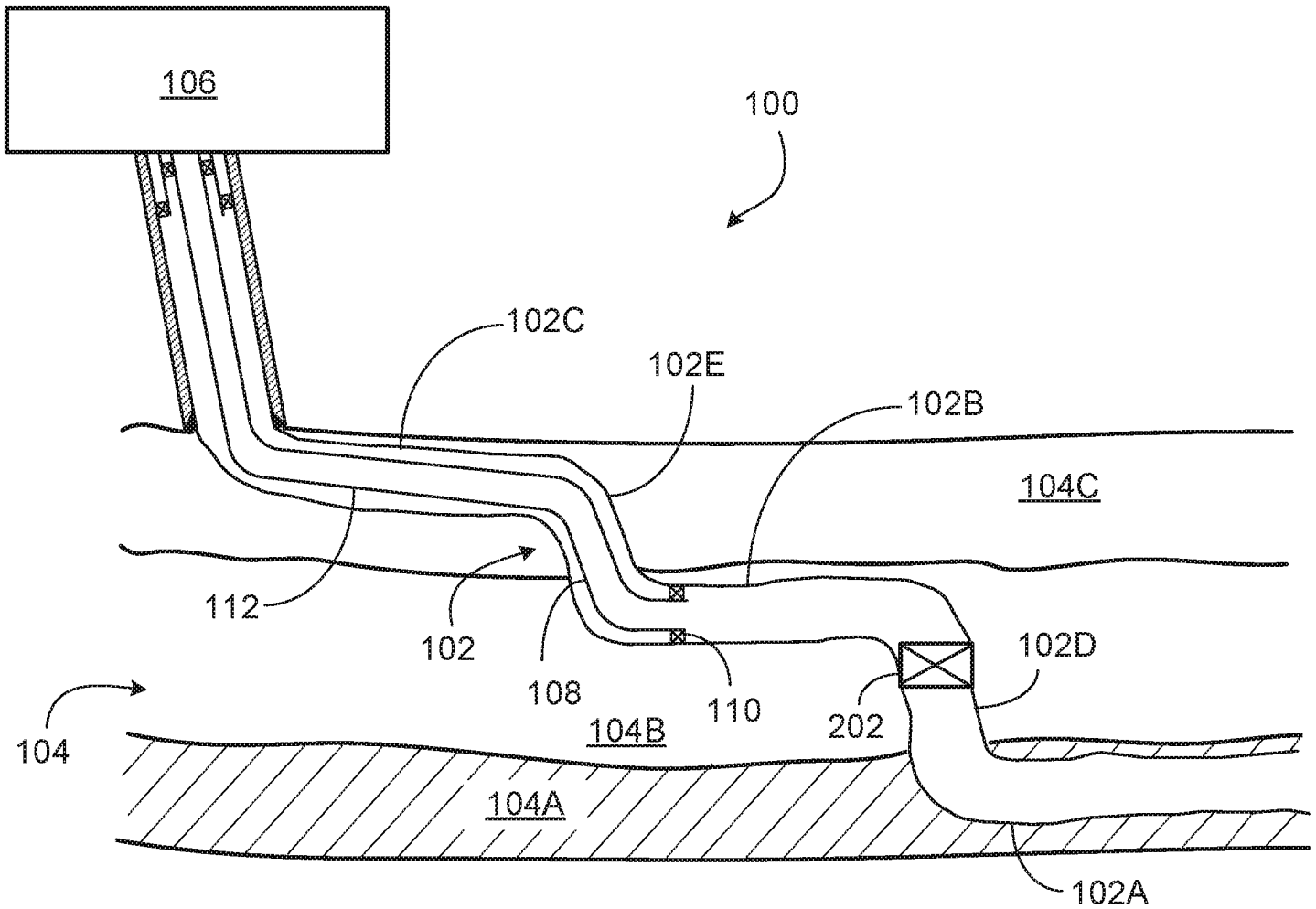
FIG. 2 is a schematic diagram of an example well production system at a second stage of production of a multi-layered reservoir with adjacent production layers.

FIG. 2 is a schematic diagram of the example well production system 100 at the second stage of production. Once the water cut in the first production layer 104*a* becomes too great, the packer 110 is unseated (unsealed), and the coiled tubing 108 is retracted from the first horizontal section 102*a* in the first layer 104*a* of the multi-layered reservoir 104 to the second horizontal section 102*b* in the second layer 104*b* of the multi-layered reservoir 104. Retracting and the coiled tubing 108 can be done using a coiled tubing truck or boat and does not require a drill rig.

As previously stated, the packer 110 is unsealing prior to retracting the coiled tubing 108 from the first layer 104*a* to the second layer 104*b*. In some implementations, the packer 110 is retracted with the coiled tubing 108. In some implementations, the packer 110 is retrieved from the wellbore 102, and a second packer is installed and resealed at a downhole end of the coiled tubing 108 after retracting the coiled tubing from the first layer 104*a* to the second layer 104*b*. In some implementations, the same packer 110 can be refurbished and reused. In some implementations, the original packer is not retrieved, and is instead abandoned within the wellbore 102. The newly seated packer 110 seals the annulus 112 from the second layer 104*b*.

Prior to producing the second layer 104*b*, a plug 202 is installed between the first horizontal section 102*a* and the second horizontal section 102*b*. As illustrated, the plug 202 is installed within the first vertical section 102*d*, but can be installed anywhere along the wellbore 102 such that the first layer 104*a* is fluidically isolated from the second layer 104*b*. The plug 202 can include an expandable plug, a cement plug, or any other plug appropriate for abandoning a section of a well.

Once the second layer 104*b* is isolated from the first layer 104*a*, production is flowed from the second layer 104*b*. Producing from the second layer 104*b* is substantially similar to producing from the first layer 104*a* with the exception of any differences described within this disclosure. The second layer 104*b* is produced through the coiled tubing 108 until the ratio of hydrocarbons to other production fluids, such as water, decreases to a value less than a specified threshold. Once the water cut becomes too great (hydrocarbon ratio becomes too small), an operator may move on to a third stage of production.

Figure 3:
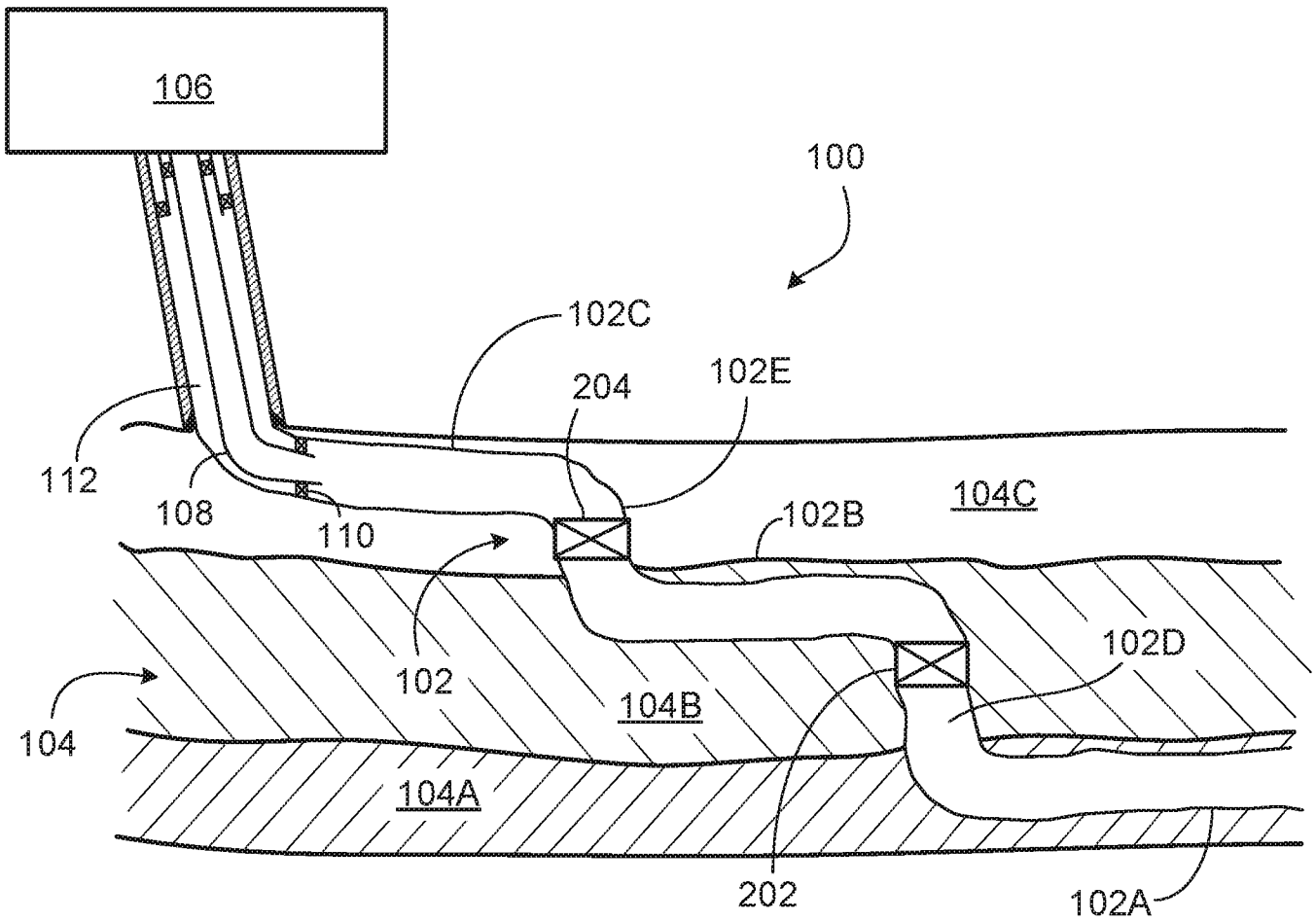
FIG. 3 is a schematic diagram of an example well production system at a third stage of production of a multi-layered reservoir with adjacent production layers.

FIG. 3 is a schematic diagram of the example well production system 100 at the third stage of production. The transition from the second stage of production to the third stage of production is substantially similar to the transition from the first stage of production to the second stage of production with the exception of any exceptions described herein. Similarly, producing from the third layer 104*c* is substantially similar to producing from the first layer 104*a* and the second layer 104*b* with the exception of any differences described herein. The transition from the second stage of production to the first stage of production includes retracting the coiled tubing from the second layer 104*b* of the multi-layered reservoir 104 to a third layer 104*c* of the multi-layered reservoir 104. The second layer 104*b* is sealed from the third layer 104*c* by a packer 110. The third layer is produced through the coiled tubing production string 108.

Prior to producing the second layer 104*c*, a plug 204 is installed between the second horizontal section 102*b* and the third horizontal section 102*c*. As illustrated, the plug 204 is installed within the first vertical section 102*e*, but can be installed anywhere along the wellbore 102 such that the second layer 104*b* is fluidically isolated from the third layer 104*c*. The plug 204 can include an expandable plug, a cement plug, or any other plug appropriate for abandoning a section of a well.

The third layer 104*c* is produced through the coiled tubing 108 until the ratio of hydrocarbons to other production fluids, such as water, decreases to a value less than a specified threshold. Once the water cut becomes too great (hydrocarbon ratio becomes too small), an operator may move on to a fourth stage of production (not illustrated).

In this instance, as there are three production layers illustrated, the fourth stage of production includes abandonment. Once the wellbore is abandoned according to local guidelines (plugging, cementing, etc.), the coiled tubing 108 can be moved to another production location and installed into a new wellbore. In some implementations, a sidetrack can be formed within the original wellbore and production can continue in a different section of the reservoir 104. While described in the context of three production layers, greater or fewer production layers can be included in each individual reservoir. In some implementations, multiple wellbores can radiate from a single, central, or vertical wellbore to produce multiple sections of a reservoir simultaneously. In such an implementation, flows can be comingled from different sections of the reservoir, or they can be fluidically isolated prior to processing at the topside facility 106. Aspects of this disclosure are applicable to both onshore and offshore production.

Figure 4:
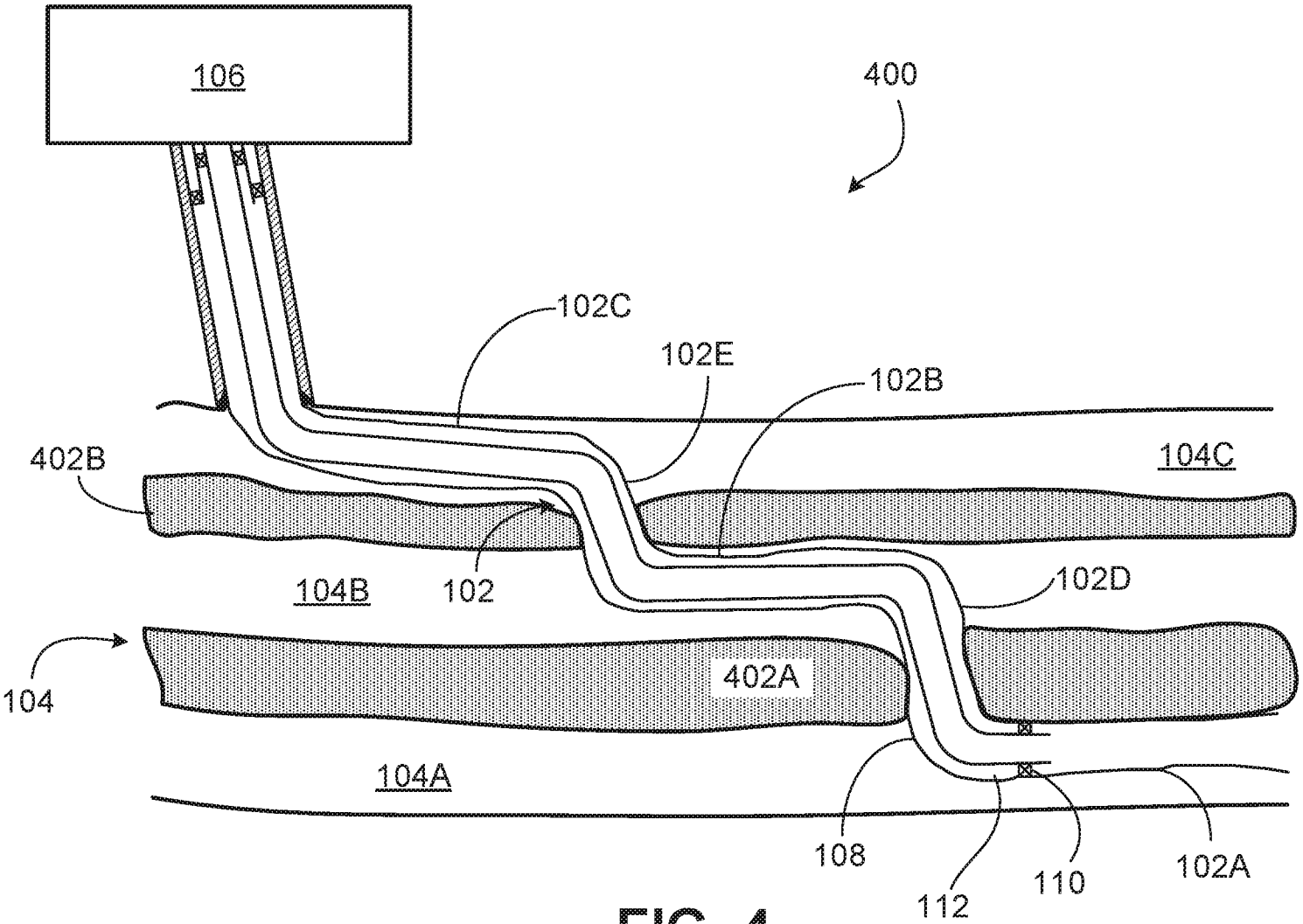
FIG. 4 is a schematic diagram of an example well production system at a first stage of production of a multi-layered reservoir without adjacent production layers.

FIG. 4 is a schematic diagram of an example well production system 400 at a first stage of production. FIG. 4 is substantially similar to FIG. 1 with the exception of any differences described herein. In FIG. 4, each production zone is isolated by a non-producing layer between each production layer. For example, the first production layer 104*a* is separated from the second production layer 104*b* by a first non-production layer 402*a*. In the context of this disclosure, a non-production layer has low permeability and less or no hydrocarbon reserves within the rock formation than the production layers. As illustrated, the second production layer 104*b* is isolated from the third production layer 104*c* by a second non-production layer 402*b*. Producing with the example, well production system 400 is substantially similar to producing with the well production system 100.

Figure 5:
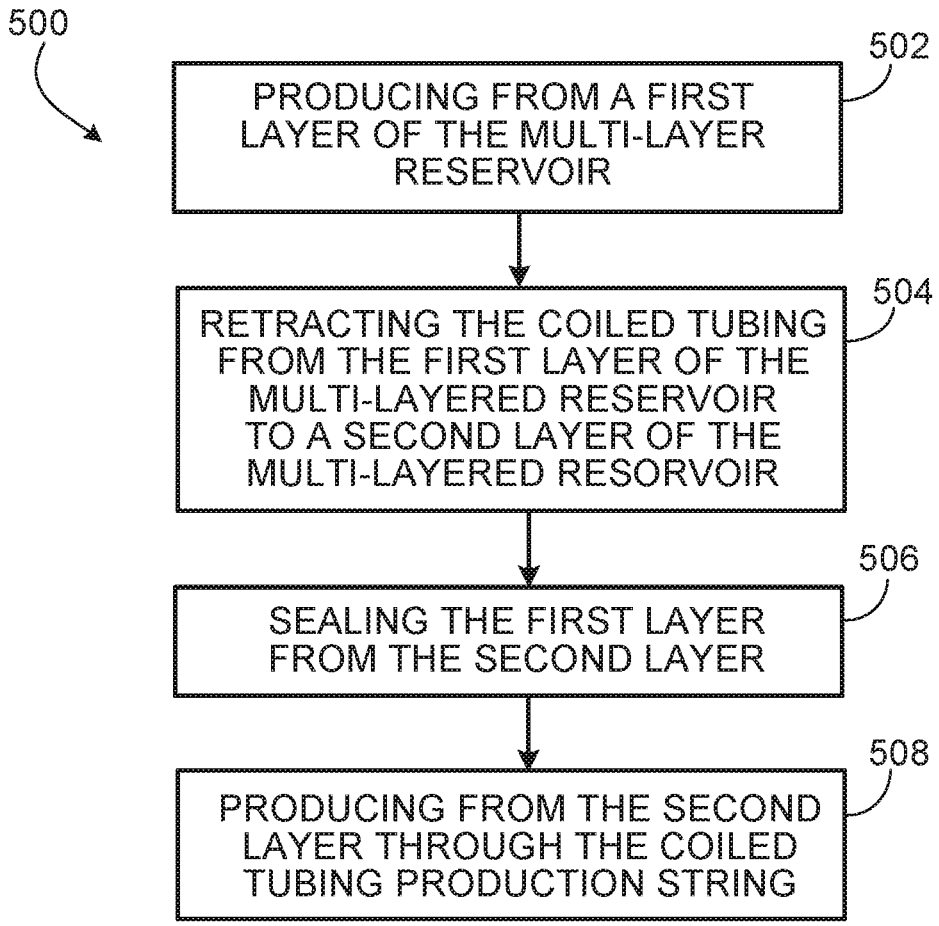
FIG. 5 is a flowchart of an example method that can be used with aspects of this disclosure.

FIG. 5 is a flowchart of an example method 500 that can be used with aspects of this disclosure. At 502, fluid is produced from a first layer of the multi-layered reservoir through a coiled tubing production string. The coiled tubing production string is located within a wellbore with a first horizontal section within the first layer. The coiled tubing production sting includes a packer at a downhole end of the coiled tubing production string. The packer seals an annulus defined by an outer surface of the coiled tubing production sting and an inner surface of the wellbore. The annulus is sealed from the first layer.

After the first layer has been sufficiently produced, the packer is unsealed. In some implementations, the packer is retracted with the coiled tubing. In some implementations, the packer is retrieved from the wellbore. At 504, the coiled tubing is retracted from the first layer of the multi-layered reservoir to a second layer of the multi-layered reservoir. Next, a second packer is installed and sealed. The same packer used in the previous layer can be refurbished and reused, or a new packer can be installed. At 506, the first layer is sealed from the second layer. That is, the second packer seals the annulus from the second layer. At 508, fluid is produced from the second layer through the coiled tubing production string.

In some instances, more than two production layers are present in the reservoir. In such instances, subsequent layers can be produced. For example, after the second layer has been sufficiently produced, the coiled tubing is retracted from the second layer of the multi-layered reservoir to a third layer of the multi-layered reservoir. In some implementations, the third layer is uphole of the second layer. The second layer is then sealed from the third layer, and the third layer is produced through the coiled tubing production string.

In some implementations, retracting the coiled tubing includes using a coiled tubing truck. In some implementations, a drill rig can be used to retract the coiled tubing. In some implementations, sealing the first layer from the second layer comprises installing a plug, for example, a cement plug. In some implementations, other sealing systems can be used, for example, a permanently installed packer. In some implementations, the first horizontal section and the second horizontal section each include open-hole completions. While primarily described as using open-hole completions, other completion methods can be used in any section of the wellbore without departing from this disclosure.

Figure 6:
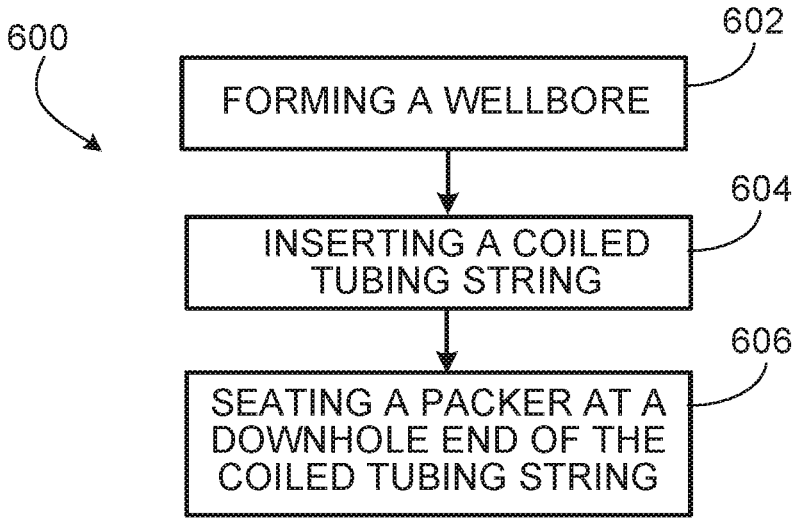
FIG. 6 is a flowchart of an example method that can be used with aspects of this disclosure.

FIG. 6 is a flowchart of an example method 600 of completing a well within a multilayered reservoir that can be used with aspects of this disclosure. At 602, a wellbore is formed. The wellbore can be formed using a drilling rig, coiled tubing drilling, or any other drilling method suitable for the desired wellbore trajectory. The wellbore includes a first horizontal section within a first layer of the reservoir and a second horizontal section within a second layer of the reservoir. The second horizontal section is uphole of the first horizontal section. In some implementations, the first horizontal section and the second horizontal section are connected by a vertical section or a deviated section. In some implementations, the first horizontal section is completed with an open-hole completion. In some implementations, the wellbore includes a third horizontal section within a third layer of the reservoir. The third horizontal section is uphole from the second horizontal section. In some implementations, the first layer is stratigraphically lower than the second layer and the second layer is stratigraphically lower than the third layer, but the methods and systems described herein can be applied to other reservoir topologies having greater of fewer layers, with different arrangements, without departing from this disclosure.

At 604, a coiled tubing string is inserted into the wellbore such that a downhole end is within the first horizontal section. At 606, a packer is seated at a downhole end of the coiled tubing string. The packer is positioned such that it seals an annulus defined by an outer surface of the coiled tubing string and an inner surface of the wellbore. The packer seals the annulus from the first horizontal section. After the annulus is sealed, fluid is produced through the coiled tubing from the first horizontal section.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described previously as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described previously should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A well-system comprising:

a wellbore formed in a layered reservoir, the wellbore comprising:

a first horizontal section within a first layer of the reservoir;

a second horizontal section within a second layer of the reservoir, the second horizontal section being uphole of the first horizontal section, wherein a downhole end of the second horizontal section is connected to an uphole end of the first horizontal section, and wherein a non-production layer is vertically stratigraphically between the first layer and the second layer;

a length of coiled tubing extending through the second horizontal section of the wellbore from a topside facility to the first horizontal section; and an annular packer positioned at a downhole end of the length of coiled tubing, the annular packer sealing an annulus defined by an outer surface of the length of coiled tubing and an inner surface of the wellbore, the annular packer sealing the annulus from the first horizontal section.

2. The well-system of claim 1, wherein the wellbore further comprises a third horizontal section within a third layer of the reservoir, the third horizontal section being uphole from the second horizontal section, the length of coiled tubing extending through the third horizontal section to the first horizontal section.

3. The well-system of claim 2, wherein the first layer is stratigraphically lower than the second layer, and wherein the second layer is stratigraphically lower than the third layer.

4. The well-system of claim 2, wherein an uphole end of the second horizontal section and a downhole end of the third horizontal section are connected by a vertical section or a deviated section.

5. The well-system of claim 1, wherein the annular packer is a retrievable annular packer.

6. The well-system of claim 1, wherein an uphole end of the first horizontal section and a downhole end of the second horizontal section are connected by a vertical section or a deviated section.

7. The well-system of claim 1, wherein the first horizontal section comprises an open-hole completion.

8. A method of completing a well within a multilayered reservoir, the method comprising:

forming a wellbore comprising:

a first horizontal section within a first layer of the reservoir;

a second horizontal section within a second layer of the reservoir, the second horizontal section being uphole of the first horizontal section, wherein a downhole end of the second horizontal section is connected to an uphole end of the first horizontal section, and wherein a non-production layer is vertically stratigraphically between the first layer and the second layer;

inserting a coiled tubing string such that a downhole end is within the first horizontal section; and seating a packer at a downhole end of the coiled tubing string, the packer sealing an annulus defined by an outer surface of the coiled tubing string and an inner surface of the wellbore, the packer sealing the annulus from the first horizontal section.

9. The method of claim 8, further comprising producing fluid through the coiled tubing from the first horizontal section.

10. The method of claim 8, wherein the first horizontal section and the second horizontal section are connected by a vertical section or a deviated section, wherein the coiled tubing string extends through the second horizontal section to the first horizontal section.

11. The method of claim 8, further comprising completing the first horizontal section with an open-hole completion.

12. The method of claim 8, wherein forming the wellbore further comprise forming a third horizontal section within a third layer of the reservoir, the third horizontal section being uphole from the second horizontal section, wherein a downhole end of the third horizontal section is connected to an uphole end of the second horizontal section.

13. The method of claim 12, wherein the second horizontal section and the third horizontal section are connected by a vertical section or a deviated section, wherein the coiled tubing string extends through the third horizontal section to at least the second horizontal section.

14. The method of claim 12, wherein the first layer is stratigraphically lower than the second layer, and wherein the second layer is stratigraphically lower than the third layer.

15. The method of claim 8, wherein forming the wellbore comprises using a drilling rig.

16. The method of claim 8, wherein completing the wellbore in the second layer does not require using a drilling rig.

17. A method of producing from a multi-layered reservoir, the method comprising:

producing from a first layer of the multi-layered reservoir through a coiled tubing production string, the coiled tubing production string being located within a wellbore comprising a first horizontal section within the first layer, the coiled tubing production string comprising a packer at a downhole end of the coiled tubing production string, the packer sealing an annulus defined by an outer surface of the coiled tubing production string and an inner surface of the wellbore, the annulus being sealed from the first layer;

retracting the coiled tubing from the first layer of the multi-layered reservoir to a second layer of the multi-layered reservoir, the second layer being uphole of the first layer, and wherein a non-production layer is vertically stratigraphically between the first layer and the second layer;

sealing the first layer from the second layer; and producing from the second layer through the coiled tubing production string, the coiled tubing production string being located within the wellbore further comprising a second horizontal section within the second layer.

18. The method of claim 17, further comprising:

unsealing the packer prior to retracting the coiled tubing from the first layer to the second layer;

retracting the packer with the coiled tubing;

retrieving the packer from the wellbore; and installing and resealing a second packer after retracting the coiled tubing from the first layer to the second layer, the second packer sealing the annulus from the second layer.

19. The method of claim 18, further comprising:

retracting the coiled tubing from the second layer of the multi-layered reservoir to a third layer of the multi-layered reservoir, the third layer being uphole of the second layer;

sealing the second layer from the third layer; and producing from the third layer through the coiled tubing production string.

20. The method of claim 17, wherein retracting the coiled tubing comprises using a coiled tubing truck.

21. The method of claim 17, wherein sealing the first layer from the second layer comprises installing a plug.

22. The method of claim 21, wherein the plug comprises a cement plug or an expandable plug.

23. The method of claim 17, wherein the first horizontal section comprises an open-hole completion.

24. The method of claim 17, wherein the second horizontal section comprises an open-hole completion after retracting the coiled tubing to the second layer.

* * * * *